United States Patent [19]

Billigmann et al.

[11] 3,982,968

[45] Sept. 28, 1976

[54] METHOD FOR THE MANUFACTURE OF A COLD-ROLLED STEEL STRIP IN THIN AND SUPER-THIN METAL PLATE THICKNESS FOR PRODUCING STRETCH-FORMED CANS OR OTHER DEEP-DRAWN PARTS

[75] Inventors: Joseph Billigmann; Christoph Schneider; Johannes Siewert, all of Andernach; Manfred Sodeik, Neuwied, all of Germany

[73] Assignee: Rasselstein Aktiengesellschaft, Neuwied (Rhine), Germany

[22] Filed: Apr. 12, 1974

[21] Appl. No.: 460,609

[30] Foreign Application Priority Data

Mar. 7, 1974 Germany ..... 2410854

[52] U.S. Cl. ..... 148/6.15 R; 148/6.15 Z

[51] Int. Cl.[2] ..... C23F 7/08

[58] Field of Search ..... 148/6.15 R, 6.15 Z, 148/155, 156; 117/66

[56] References Cited

UNITED STATES PATENTS

| | | | |
|---|---|---|---|
| 2,165,635 | 7/1939 | Keighley | 148/6.14 R |
| 2,992,145 | 7/1961 | Santangelo et al. | 148/6.15 R |
| 3,556,867 | 1/1971 | Glasson | 148/6.15 Z |

*Primary Examiner*—Ralph S. Kendall
*Assistant Examiner*—Charles R. Wolfe, Jr.
*Attorney, Agent, or Firm*—Woodhams, Blanchard and Flynn

[57] ABSTRACT

In the manufacture of cold-rolled steel strip in thin and super-thin strip thicknesses, especially for stretch-forming and deep-drawing operations, the strip after annealing is coated with a liquid containing preferably both a phosphatizing reactant and a lubricant, the strip is then rolled up to hold the liquid between the layers thereof and the retained heat within the strip is utilized to effect the phosphatizing reaction. In one specific embodiment of the invention the strip after annealing is advantageously cooled to a temperature of approximately 100° C. prior to the coating thereon of the phosphatizing and lubricating liquid. In a variation of the invention the liquid coated onto the strip contains only the phosphatizing reactants and the lubricant is separately applied if needed upon the unrolling of the strip.

3 Claims, No Drawings

METHOD FOR THE MANUFACTURE OF A COLD-ROLLED STEEL STRIP IN THIN AND SUPER-THIN METAL PLATE THICKNESS FOR PRODUCING STRETCH-FORMED CANS OR OTHER DEEP-DRAWN PARTS

FIELD OF THE INVENTION

The invention relates to a method for the manufacture of a cold-rolled steel strip in thin and super-thin strip thicknesses for producing stretch-formed cans or other deep-drawn parts, in which after annealing the strip is further heat treated with a liquid which contains both a phosphatizing medium and a lubricant.

BACKGROUND OF THE INVENTION

To produce less expensive cans, for example, for beverages by deep drawing and stretch forming, experiments have been carried out for a long period of time in the use of untreated steel sheet for this purpose. Worthwhile results, however, have up to now not been obtained. Due to the locally high unit pressure during the stretch-forming operation, even when high pressure lubricants are used, after a short period of time, galling will occur between the workpiece and the tool caused by local welding of the steel onto the necessary hard metal tools. Therefore, at the present time beverage cans are being manufactured of tin-plated steel sheet (tin plate). The tin-plating acts as a separating layer and avoids such galling.

It is also known in other areas of this type of technology that phosphatized sheet metal, that is, sheet metal, which is provided with a thin phosphate coating, tends at the most to undergo only a minor degree of galling during a deep-drawing operation. However, the phosphatizing must be effected by a special operation and subsequently the phosphatized sheet metal must still be provided with an oil film which prevents rusting of the sheet metal and furthermore acts as a lubricant during the deep drawing. Due to these additional method steps, the phosphatized sheet metal cannot be manufactured at any appreciably less cost than tin-plated sheet metal.

In order to carry out the phosphatizing and the application of the lubricant in one operation, an acid reaction lubricant is known under the term Bonderlube 460 and 461 (Registered Trademark). This acid reaction lubricant Bonderlube 460 and 461 is sold by Metallgesellschaft AG Frankfurt (Main). It contains both a phosphatizing medium and a lubricant. In such treatment the annealed steel strip is dipped for a substantial period of time into the liquid, which liquid contains the phosphatizing medium and the lubricant. The bath temperature is normally at 65°–70° C., and the dipping time is approximately 10 minutes. After the treatment, the treated strip must hang for approximately 5 minutes above the bath container so that most of the excess lubricant can run off. Prior to the further deformation, the strip is permitted to assume room temperature in an inclined position. Through the treatment in the mentioned liquid, both a phosphate layer and also a lubricant layer is produced in the strip. The phosphate layer has the characteristic of better holding of the lubricant and the lubricant serves to protect against rust. During the cold forming the phosphate layer acts as a separating layer and the lubricant acts to lubricate the operation.

However, in this method, there exists the disadvantage that the strip must be dipped for a relatively long period of time into the liquid. Thus, it is not possible, or it is possible only with a considerable expense, to proceed immediately after the annealing with the phosphatizing, because either the annealing would have to be carried out extremely slowly or, following the continuous furnace, a correspondingly long bath would have to be available so that the strip, from the time of its entering into the bath until it exits therefrom, remains at a travelling speed which is the same as that used for the continuous annealing. However, such a method would be just as uneconomical as the separate continuous annealing at a normal strip speed and the phosphatizing at a low strip speed in a separate method step.

Thus, the basic purpose of the invention is to improve a method for the manufacture of a cold-rolled steel strip in thin and super-thin strip thicknesses for producing stretch-formed cans or other deep-drawn parts of the above-mentioned type in a less expensive manner than was previously known.

SUMMARY OF THE INVENTION

This is achieved according to the invention by cooling the strip following the annealing step to a temperature of between 120° and 50° C., then applying the liquid to the hot strip in a thin film and thereafter rolling the strip to form a roll with the still wet liquid film, so that the remaining heat which is stored in the roll is utilized for the chemical phosphatizing reaction.

DETAILED DISCUSSION

Contrary to known phosphatizing methods, the strip in the new method does not remain during the entire reaction time, which is required for the phosphatizing, in the liquid bath which is heated to the necessary temperature, but instead, liquid containing the phosphatizing means and the lubricant is applied to the still hot strip and then the strip is rolled up with a still wet liquid film. The actual phosphatizing reaction then takes place in the rolled-up roll. Since such a steel strip roll having some tons of weight cools relatively slowly, there is sufficient reaction time available without the special techniques previously required. The strip can run with the usual speed through the continuous annealing furnace and is subsequently cooled only so far that it still has the heat necessary for the reaction. The heat which is fed to the strip for the annealing operation is thereafter used partly for heating the liquid and for maintaining the temperature which is necessary for the phosphatizing reaction. It is therefore also not necessary to bring the reaction liquid to the required temperature of 65° – 70°, but same can be applied at room temperature advantageously through roller application or through spraying on the strip. It is also possible if desired to permit the strip to dip into a liquid bath for a short distance. In any case, the previously required heating and maintaining of the temperature of the liquid bath is no longer needed.

After the complete slow cooling of the steel strip roll, the phosphatizing operation is concluded. The phosphate layer protects together with the oil the steel strip against corrosion until it is further processed. During the further processing through stretch forming or deep drawing, the phospate layer acts as a separating layer and the oil as a lubricant.

To what temperature the strip is cooled after the annealing depends on the dimensions of the steep strip roll and what reaction time is required for the respective liquid. Therefore, the temperature must be so controlled that the liquid does not evaporate or dry as the steel strip together with the yet wet liquid film is rolled up. However, it must be sufficient so that during the cooling time of the steel strip roll, the necessary reaction temperature is actually available. The larger the steel strip roll, the longer is its cooling-off time.

The strip is advantageously, after the annealing and prior to the application of the liquid, cooled to a temperature of approximately 100° C. This assures that on the one hand the liquid does not evaporate or dry and on the other hand during the reaction time that the necessary reaction temperature is present.

Furthermore, it is advantageous if the strip after being rolled up is further processed without cold finishing (dressing). On the one hand the separate operation of the dressing is thus eliminated and on the other hand it has been found that such a nondressed steel plate is just as suitable for the stretch forming as a dressed steel strip. This, however, does not prevent the steel strip from being subjected if desired to a dressing procedure prior to being processed in the punch-drawing press or a cup-drawing press, which dressing procedure serves only to overcome unevennesses and the roll twist of the strip.

According to the inventive method the strips is treated in a liquid which contains both a phosphatizing medium and a lubricant. Phosphatizing media are diluted solutions of acid zinc phosphate in which phosphoric acid and oxidizing agents (nitrate and the like) are mixed. If necessary, it is conceivable to treat the strip according to the inventive method in a liquid which contains only a phosphatizing medium. Through this also the treatment time required for the phosphatizing is materially shortened. Of course, it would then be necessary prior to the cold forming to apply a lubricant during the unrolling of the strip. This method can, however, only be used if the strip is further treated as quickly as possible after the phosphatizing in order to prevent the strip from corroding between the phosphatizing and the further treatment.

Although a particular preferred embodiment of the invention has been disclosed above for illustrative purposes, it will be understood that variations or modifications thereof which lie within the scope of the appended claims are fully contemplated.

The embodiments of the invention in which an exclusive property or privilege is claimed are defined as follows:

1. A method for treating cold-rolled steel strip to form a phosphate-coating layer on said strip and to apply a lubricant layer thereon, comprising the steps of: annealing the strip in a continuous furnace and then cooling the strip from the annealing temperature to a temperature in the range of from 50° to 120°C; applying to the strip having a temperature in said range a thin liquid coating film consisting essentially of a phosphatizing composition and an oil lubricant, said liquid coating film being capable of remaining liquid during the following coiling step; coiling the strip having said thin liquid coating film thereon to form a coil; and while the steel strip is in the coil form, cooling the coil further while utilizing the heat remaining in the coil to effect a phosphatizing reaction of said composition with said steel strip to form the phosphate coating layer on the strip.

2. A method according to claim 1 wherein said thin liquid coating film is applied onto the strip by rolling or spraying.

3. A method according to claim 1 wherein the temperature of the strip is approximately 100°C when the thin liquid coating film is applied thereof.

* * * * *